US006773785B1

(12) United States Patent
Huang

(10) Patent No.: US 6,773,785 B1
(45) Date of Patent: Aug. 10, 2004

(54) AIR CUSHION

(76) Inventor: Ing-Jing Huang, 218 Cheng Kong 3rd Road, Nantou City (TW)

( * ) Notice: Subject to any disclaimer, the term of this patent is extended or adjusted under 35 U.S.C. 154(b) by 0 days.

(21) Appl. No.: 09/868,908

(22) PCT Filed: Jun. 4, 1997

(86) PCT No.: PCT/US97/09742

§ 371 (c)(1),
(2), (4) Date: Jul. 9, 2001

(87) PCT Pub. No.: WO98/54995

PCT Pub. Date: Dec. 10, 1998

(30) Foreign Application Priority Data

Jun. 4, 1997 (TW) ..... 85106635 A

(51) Int. Cl.[7] ..... B32B 3/02; A43B 13/20

(52) U.S. Cl. ..... 428/68; 428/69; 428/71; 428/76; 36/29; 36/3 R; 36/3 B; 36/35 B

(58) Field of Search ..... 36/28, 29, 88, 36/3 R, 3 B, 35 B; 428/68, 69, 76, 71

(56) References Cited

U.S. PATENT DOCUMENTS

| | | | | |
|---|---|---|---|---|
| 4,183,156 A | | 1/1980 | Rudy | 36/44 |
| 4,187,620 A | | 2/1980 | Selner | 36/28 |
| 4,217,705 A | | 8/1980 | Donzis | 36/29 |
| 4,219,945 A | | 9/1980 | Rudy | 36/29 |
| 4,670,995 A | | 6/1987 | Huang | 36/29 |
| 5,117,566 A | | 6/1992 | Lloyd et al. | 36/29 |
| 5,353,525 A | | 10/1994 | Grim | 36/88 |
| 5,515,622 A | | 5/1996 | Lee | 36/3 |
| 5,537,762 A | | 7/1996 | Walters | 36/28 |
| 5,606,806 A | | 3/1997 | O'Dwyer | 36/3 |
| 5,669,161 A | * | 9/1997 | Huang | 36/43 |
| 6,428,865 B1 | * | 8/2002 | Huang | 428/35.7 |

* cited by examiner

*Primary Examiner*—Terrel Morris
*Assistant Examiner*—Hai Vo
(74) *Attorney, Agent, or Firm*—Jacobson Holman PLLC

(57) ABSTRACT

A three dimensional air cushion having a sealed outer peripheral edge of a geometric shape. The projected area of the hollow interior sealed by the outer peripheral edge is smaller than the upper surface area of the air cushion. Air chambers are provided in an upper surface and a lower surface of the cushion, giving excellent buffering function. Two opposite sides of the cushion have a level higher than an intermediate portion to force an object it protects, or a shock source, to move to the center, with the shock energy converted into side support energy, thus obtaining great stability.

45 Claims, 9 Drawing Sheets

AIR CUSHION

This application was nationalized from PCT/US97/09742 filed Jun. 4, 1997 in English.

BACKGROUND OF THE INVENTION

Common sportswear such as sneakers, protective pads, helmets, etc, have used traditional sponge, foam rubber, or polymer compositions as shock-absorbing materials. Air inflated cushions have gradually been taking the place of these traditional materials, utilizing gas or liquid contained in an air cushion for absorbing shocks.

An air cushion is generally made of two sheets placed one on the other and sealed tightly at outer circumferential edges to form a hollow interior inflated with a gas or a liquid. Another kind of air cushion is made by means of an injection molding process to produce a three dimensional air cushion with a hollow interior and then inflating air chambers provided therein with a gas or a liquid.

A cushion as shown in FIG. 1 is made of two sheets placed one on the other and fused together to have an upper flat surface. When a shock is imparted to its surface, it is received on a spot of the cushion and then dispersed gradually to other surfaces. This kind of cushion absorbs only a little shock, and therefore required for energy dispersion is comparatively large. In addition, its center of gravity is high so that instability produced by shock is accordingly increased.

As can be understood from the stabilizing principles of physics, a cushion with a flat surface can barely support an exterior high force. Such a cushion can only have a shock-absorbing function for an object the cushion is protecting A hollow three dimensional cushion as shown in FIG. 2, made by means of an injection molding process, may have a curved upper surface for contacting an object protected by it, but the cushion does not have a structure of shape memorization, and has to rely on an exterior layer added on its surface to form its upper curved surface. The whole curved surface of the cushion is nearly under the lower surface of the object protected, i.e. a shocking surface so that when a shock or a pressure is added to the surface of the cushion by the object, the shock or pressure force cannot be dispersed to two sides, as the cushion is provided with no higher side walls than the height of the cushion. Therefore a shock energy it receives is only temporarily converted into a side effect, limited in absorbing and stabilizing shock, which is not an ideal structure for a cushion.

SUMMARY OF THE INVENTION

The main purpose of the invention is to offer an air cushion with a better structure for shock-absorbing and stability.

A three dimensional air cushion according to the invention is shown in FIG. 3, intended to have the following advantages.

1. Comparatively higher sides, two or three of which are provided with air chambers extending from a center portion so that the air cushion and an object it protects may contact with a curved surface so that dispersion of a surface receiving shock may be increased to minimize moving shock energy, and to maximize a compressible area, and consequently to obtain the largest shock-absorbing effect.

2. It can sufficiently convert shock energy added on an intermediate upper surface into outer side support energy.

3. When shock or pressure disappears, the side support energy can completely return to the point of the shock, forming a rebound energy producing an excellent rebounding effect.

The buffer-functioning and shock-absorbing effect of air cushions according to the invention has been tested by SATRA FOOTWEAR TECHNOLOGY CENTER in England, and proved to be so far the best structural design for practical use.

BRIEF DESCRIPTION OF THE DRAWINGS

This invention will be better understood by referring to the accompanying drawings. wherein.

DETAILED DESCRIPTION OF THE PREFERRED EMBODIMENTS

Figure 4:
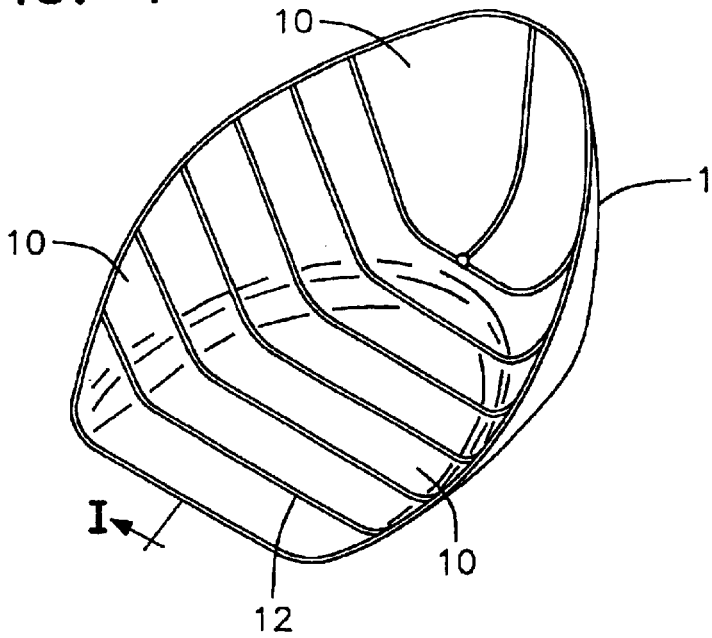
FIG. 4 is a perspective view of a first preferred embodiment of an air cushion of the present invention.
Figure 5:
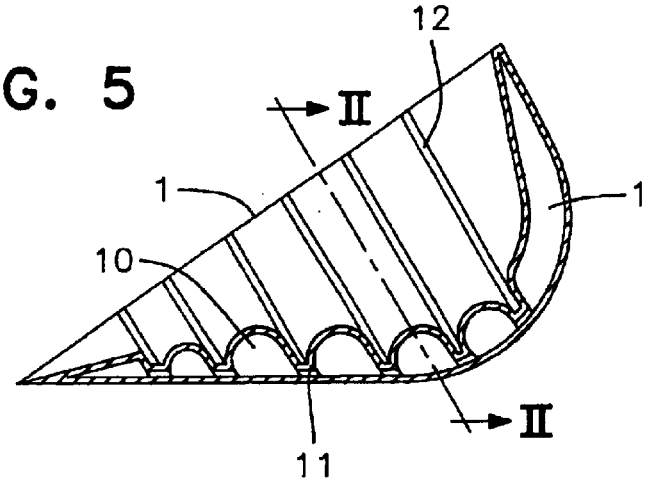
FIG. 5 is a cross-sectional view taken along line I—I in FIG. 4*a*.
Figure 6:
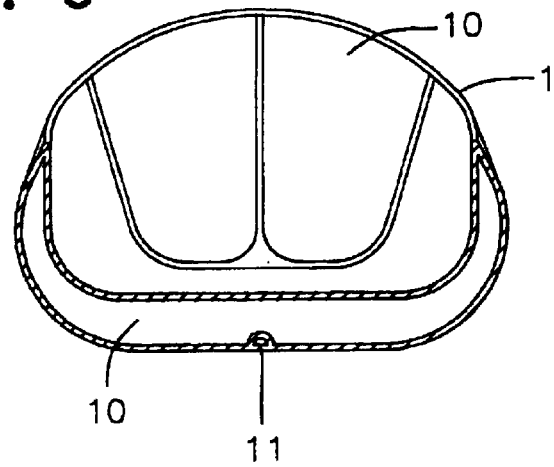
FIG. 6 is a cross-sectional view taken along line II—II in FIG. 5.
Figure 4A:
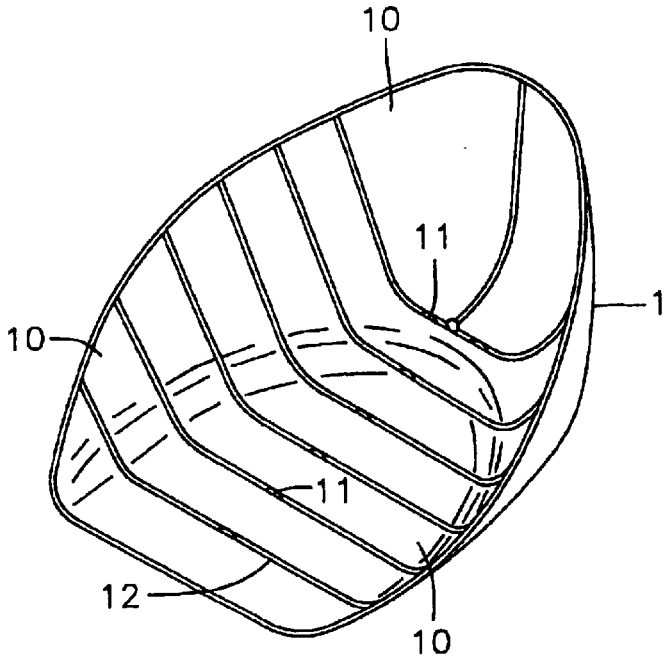
FIG. 4*a* is an alternate embodiment of the first preferred embodiment of an air cushion of the present invention.
Figure 10:
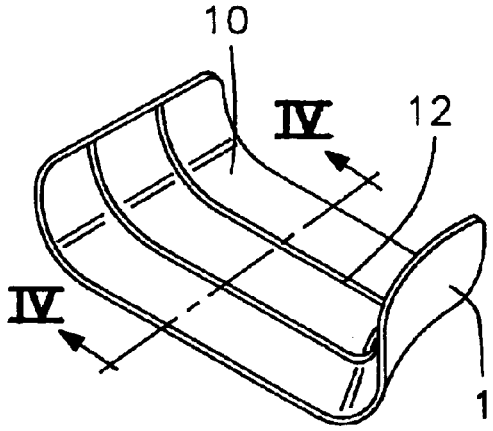
FIG. 10 is a perspective view of a fourth preferred embodiment of an air cushion of the present invention.
Figure 12:
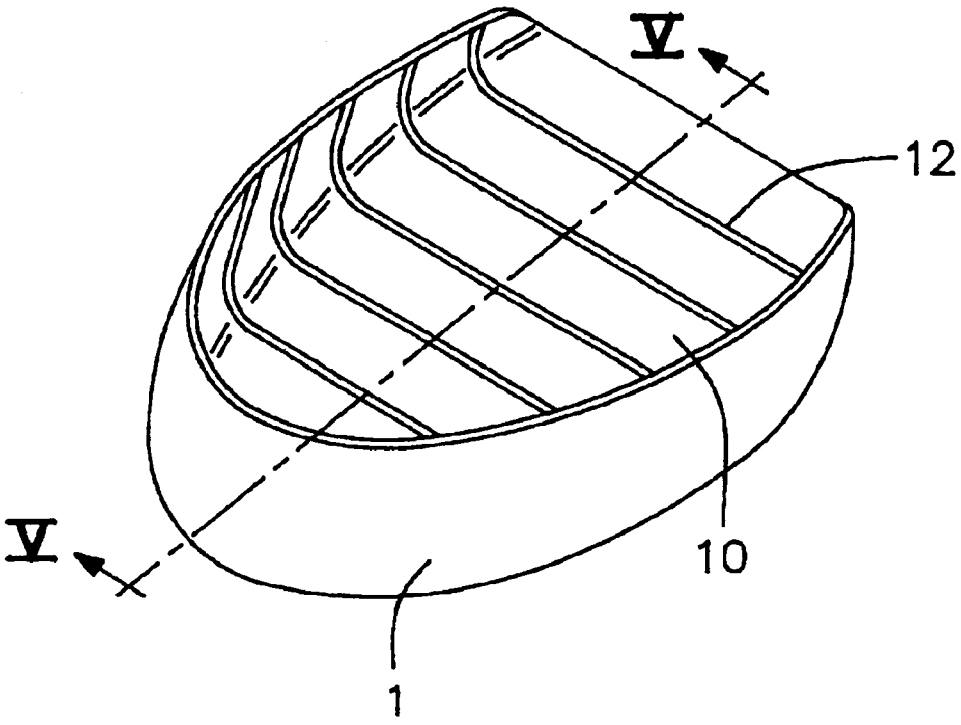
FIG. 12 is a perspective view of a fifth preferred embodiment of an air cushion of the present invention.

A three dimensional air cushion of the present invention can be formed as a heel air cushion as shown in FIG. 4, a foot bottom air cushion as shown in FIG. 10 or a shoe sole air cushion as shown in FIG. 12, not limited in its shape, and adaptable to sneakers, protective pads, helmets, etc.

A first preferred embodiment of a three dimensional air cushion of the present invention, as shown in FIGS. 4, 4*a*, 5 and 6, includes one or more independent air chambers 10 or communicated air chambers 10 with passageways 11. Every air chamber 10 can extend to two opposite sides of the cushion body 1, forming a three dimensional inner upper surface an a lower flat smooth curved surface not protruding into the air chambers 10. The sealed peripheral edge of the cushion body 1 can be of a geometric shape. The hollow interior surrounded by the sealed peripheral edge has a projected surface area smaller than the upper surface area of the cushion body 1. The cushion body 1 is of a curved shape occupying a three dimensional space, adaptable to be inwardly recessed or having swollen curved cushions.

Figure 7:
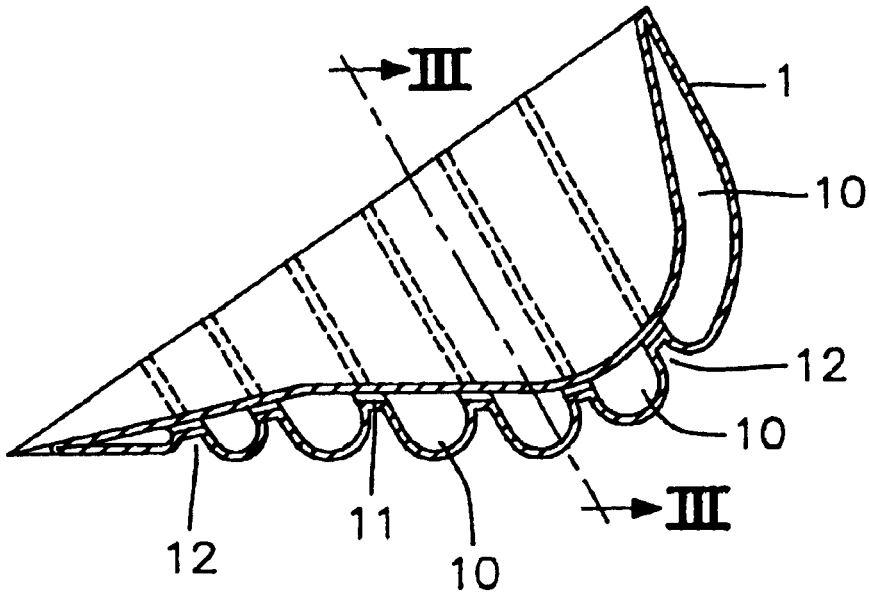
FIG. 7 is a cross-sectional view of a second preferred embodiment of an air cushion of the present invention.
Figure 8:
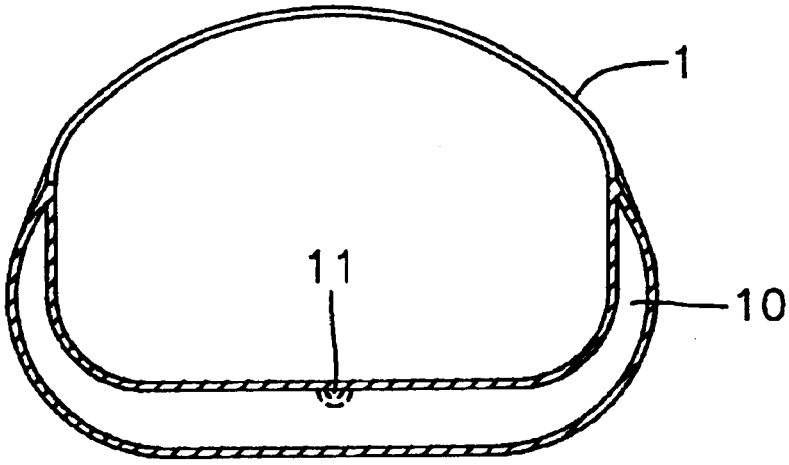
FIG. 8 is a cross-sectional view taken along line III—III in FIG. 7.

A second preferred embodiment of an air cushion of the present invention, as shown in FIGS. 7 and 8, includes a cushion body 1, one or more air chambers as the first preferred embodiment, with one or more recessed elongated grooves 12 provided in a lower surface so as to form a three dimensional recessed surface, and the upper surface is formed flat and smooth with a curvature.

Figure 9:
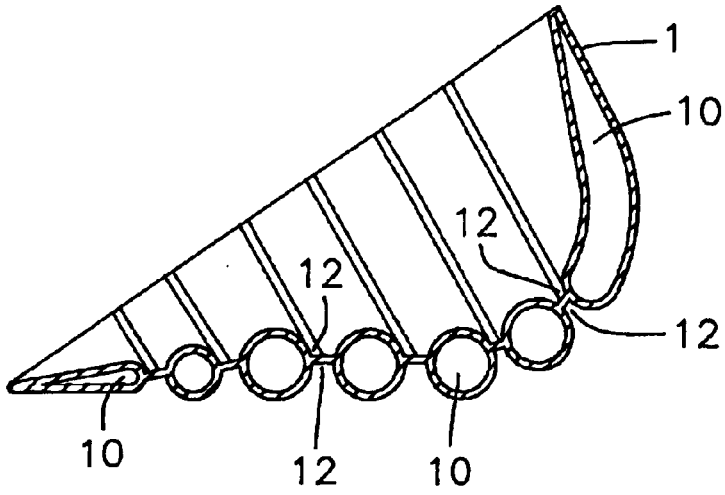
FIG. 9 is a cross-sectional view of a third preferred embodiment of an air cushion of the present invention.

A third preferred embodiment of an air cushion of the present invention, as shown in FIG. 9, is formed almost the same as the second preferred embodiment, but with one or more elongated grooves 12 formed both on the upper surface and the lower surface.

Figure 11:
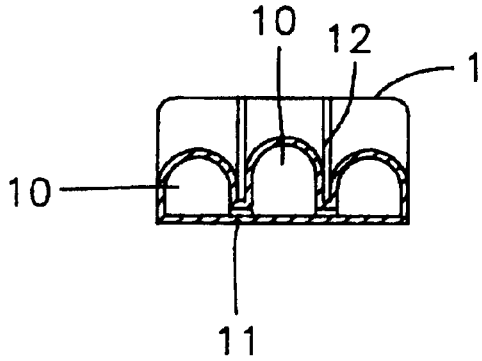
FIG. 11 is a cross-sectional view taken along line IV—IV in FIG. 10.

A fourth preferred embodiment of an air cushion of the present invention, as shown in FIGS. 10 and 11, includes a cushion body 1, formed to support a foot bottom, having elongated grooves 12 formed in an upper surface or in a lower surface as shown in FIG. 8, or in both the upper and the lower surface as shown in FIG. 9. As this foot bottom air cushion is to be fixed in an intermediate portion of a sneaker, the two opposite sides are curved upwardly in a preset angle, different from the three dimensionally curved inward or swollen air cushion described above. The special feature of this air cushion is that the inner surface area is smaller than the outer surface area, and each elongated groove 12 of each air chamber 10 has two ends with a projected line extending nearly vertically to the projected elevational surface of the groove.

Figure 13:
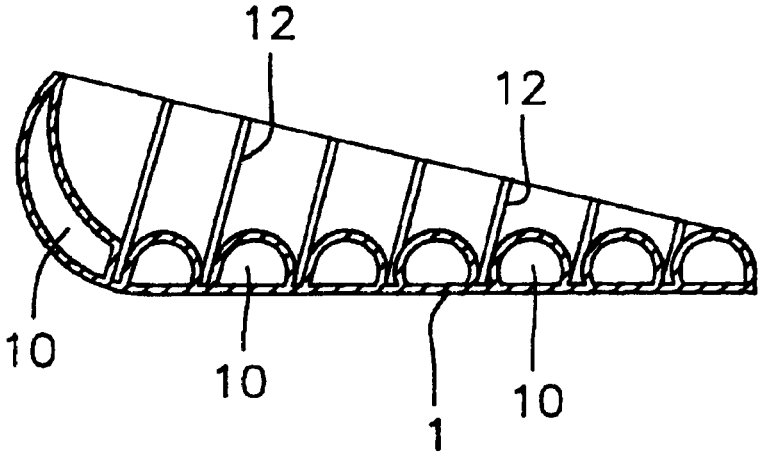
FIG. 13 is a cross-sectional view taken along line V—V in FIG. 12.

A fifth preferred embodiment of an air cushion of the present invention, as shown in FIGS. 12 and 13 includes an air cushion for use in a toe region of a foot bottom.

Figure 14:
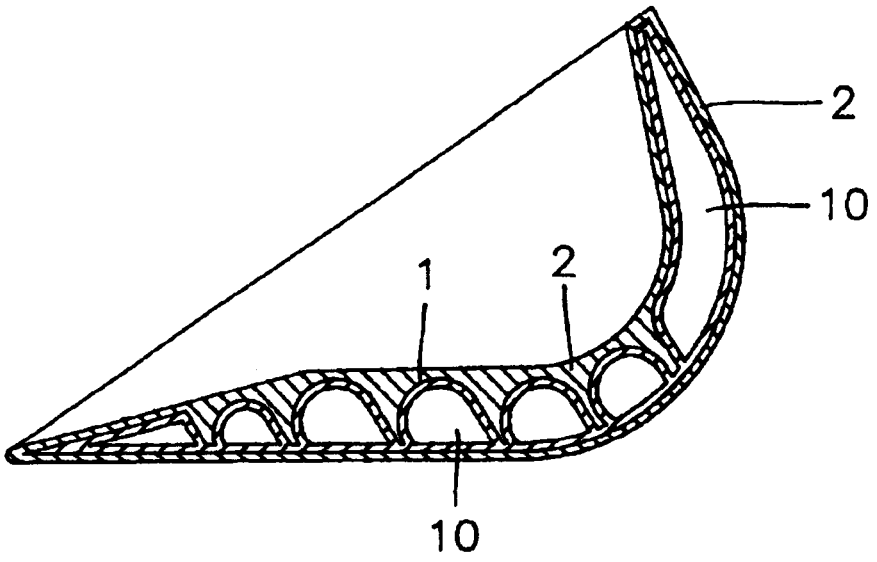
FIG. 14 is a cross-sectional view of a sixth preferred embodiment of an air cushion of the present invention.

A sixth preferred embodiment of an air cushion of the present invention, as shown in FIG. 14, includes an outer layer 2 of a different material from the cushion body 1 added on the cushion body 1 of the first preferred embodiment, but also adaptable to other air cushions.

Figure 15:
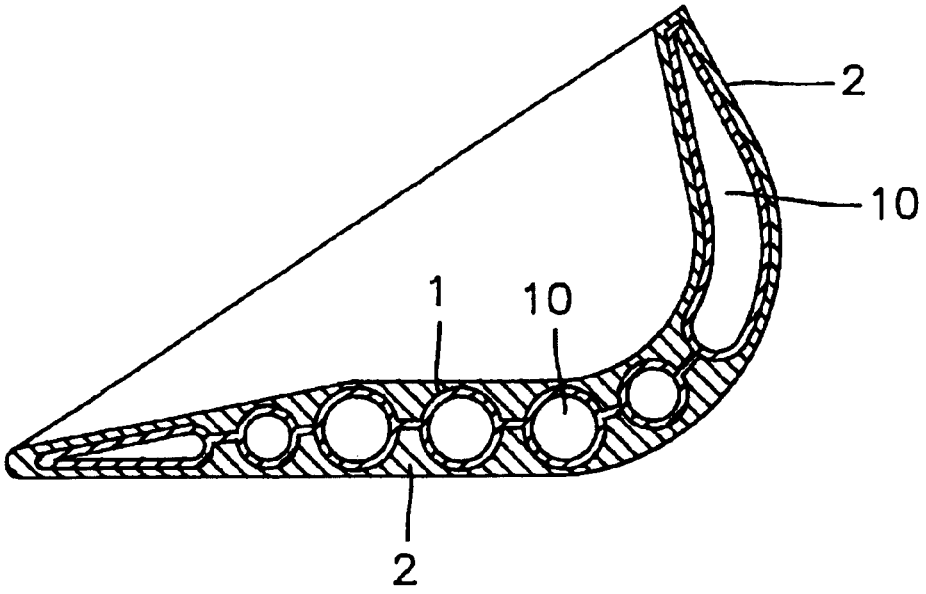
FIG. 15 is a cross-sectional view of a seventh preferred embodiment of an air cushion of the present invention.

A seventh preferred embodiment of an air cushion of the present invention, as shown in FIG. 15 includes an outer layer 2 of a different material from the cushion body 1 added on the cushion body of the third preferred embodiment shown in FIG. 9.

The air chambers 10 provided in a cushion body 1 of the various preferred embodiments can be filled with a gas, or a liquid, as the air cushion 1 itself is a hollow sealed body. In addition, a one-way air valve and pump device may be attached with the air cushion body 1 for filling its interior with a needed pressure with a gas or a liquid.

Figure 19:
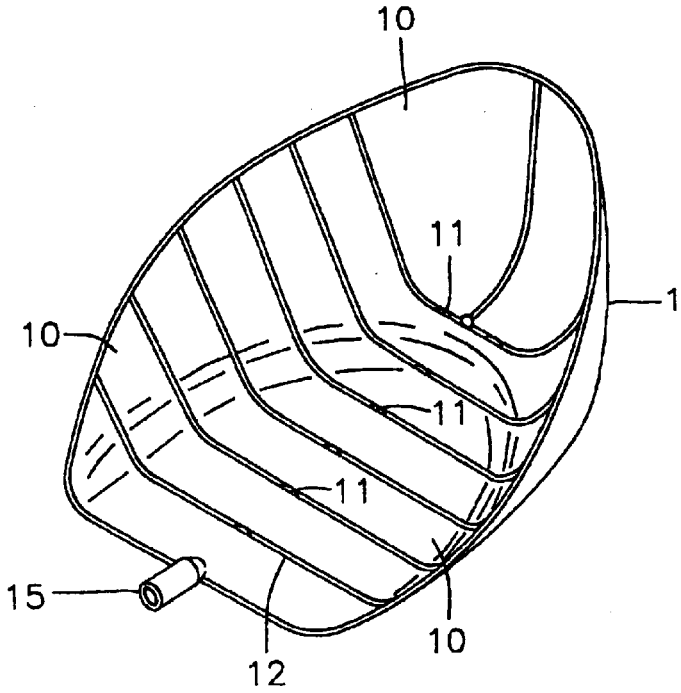
FIG. 19 is a perspective view of a tenth preferred embodiment of an air cushion of the present invention.
Figure 17:
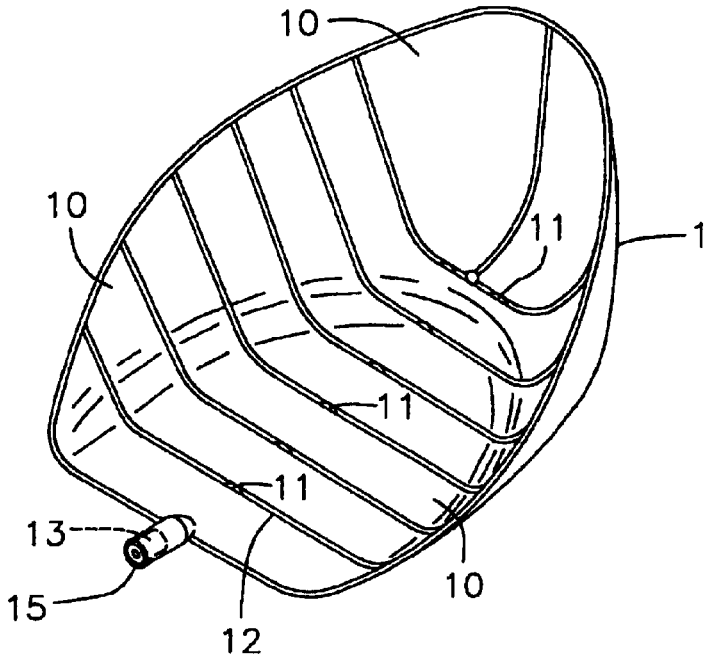
FIG. 17 is a perspective view of a eighth preferred embodiment of an air cushion of the present invention.
Figure 18:
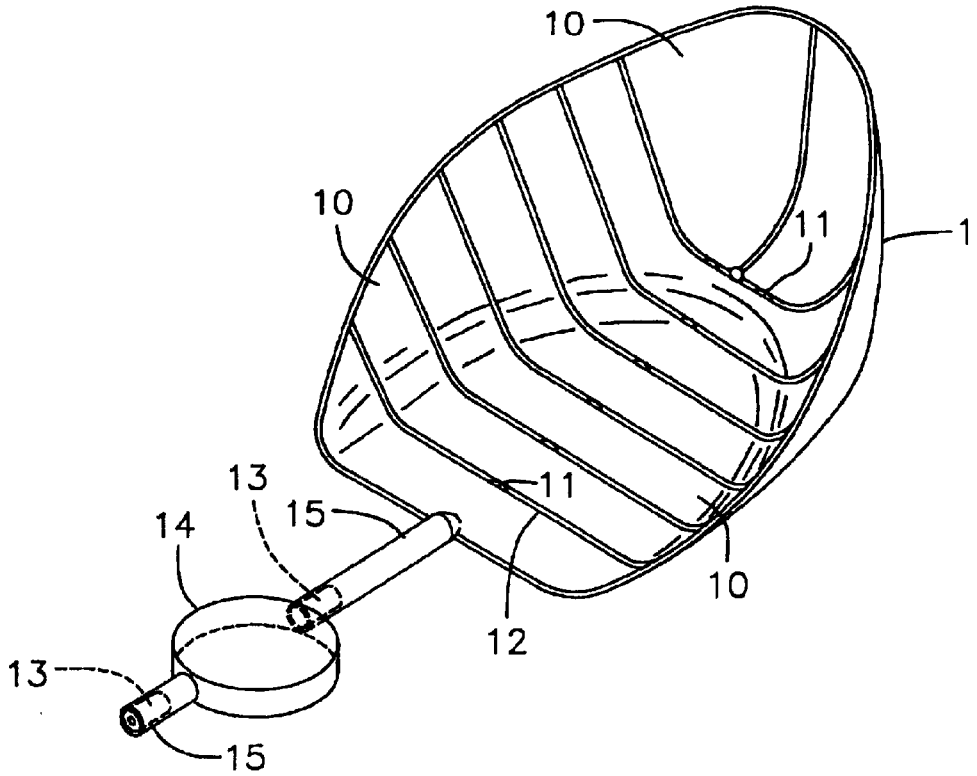
FIG. 18 is a perspective view of a ninth preferred embodiment of an air cushion of the present invention.

An eighth, ninth and tenth preferred embodiment of an air cushion of the present invention, as shown in FIGS. 17–19, includes a fluid inlet 15, including a valve 13 (as shown in FIG. 17) or two valves 13 (as shown in FIG. 18) located on opposite sides of a pump device 14.

Figure 16:
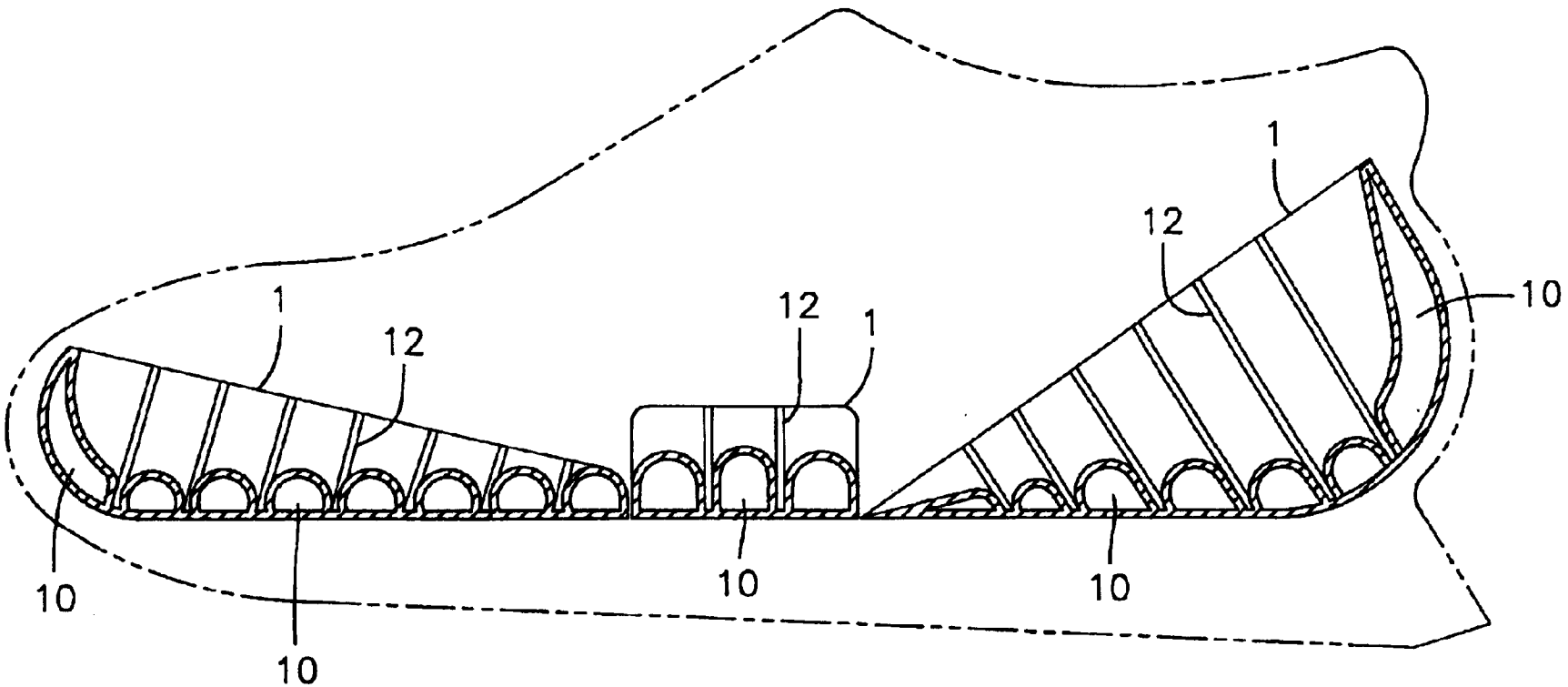
FIG. 16 is a cross-sectional view of various air cushions of the invention practically utilized in a sneaker.

FIG. 16 shows the three air cushions shown in FIGS. 4, 10 and 12, adapted to be used on a sneaker. The air cushions can be used without or with an outer layer added, with a wide variation of details. Besides, recessed grooves in an upper surface and/or a lower surface can be made independent or connected with each other.

Figure 1:
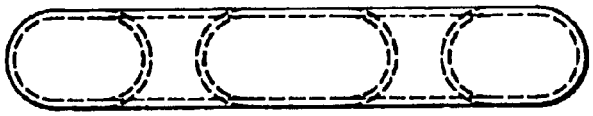
FIG. 1 (PRIOR ART)
FIG. 1 is a side cross-sectional view of a conventional air cushion with an upper flat surface as in the present invention.
Figure 2:
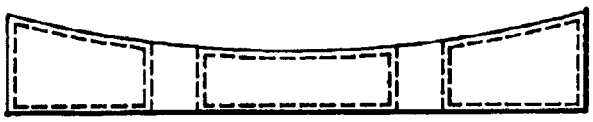
FIG. 2 (PRIOR ART)
FIG. 2 is a side cross-sectional view of a conventional air cushion with an upper curved-down surface as in the present invention.
Figure 3:
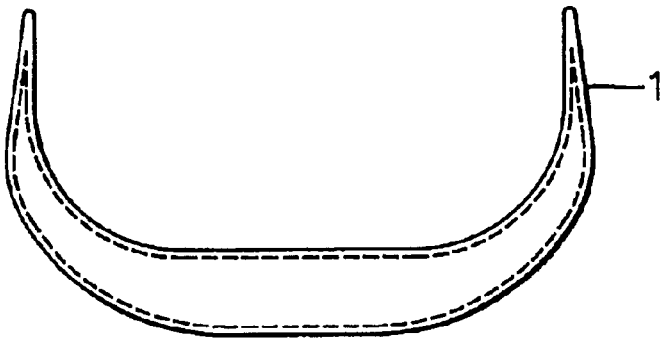
FIG. 3 is a side cross-sectional view of an air cushion of the present invention.

Referring to FIG. 3, the air chambers 10 of the air cushion 1 extend to two curved-up opposite sides, having a curved surface contacting an object protected by it, increasing the dispersing shock-bearing surface to produce a minimum moving of shock energy and comparatively large compressible dimensions to produce maximum shock-absorbing effect. When the air cushion 1 receives a downward shock, the shock pressure will disperse to the two higher sides so that the two opposite higher sides receive larger pressure to produce a clamping effect against the object or the shock source. Then the object, for example a foot, will be moved to the center of the air cushion. In other words, the air cushion can automatically clamp the object or the shock source towards its center and consequently obtain the largest stability. If the shock disappears, the dispersed pressure to the two sides will move back to the location of the shock, forming a rebounding force, and thus giving the air cushion an excellent shock-absorbing function.

While the preferred embodiments of the invention have been described above, it will be recognized and understood that various modifications may be made therein and the appended claims are intended to cover all such modifications which may fall within the spirit and scope of the invention.

What is claimed is:

1. A three dimensional air cushion comprising:

a plurality of interconnected air chambers said plurality of interconnected air chambers defining a base portion and two opposed lateral sides located on opposite sides of and extending from the base portion to form a substantially concave structure, the base portion and the two lateral sides being formed between an upper surface layer and a lower surface layer bounding an interior space, said two opposed lateral sides projecting above a plane containing said base portion to form elevated sidewalls of air cushioning capability with the base portion for distributing shock forces delivered to at least one of the plurality of interconnected air chambers at one of the two side walls and distributing the shock forces throughout a remainder of the plurality of interconnected air chambers including the base portion.

2. The three dimensional air cushion as claimed in claim 1, wherein said plurality of interconnected air chambers are sealed.

3. The three dimensional air cushion as claimed in claim 1, wherein said plurality of interconnected air chambers have a one-way valve to communicate with open air.

4. The three dimensional air cushion as claimed in claim 1, wherein the upper surface layer is provided with at least one recessed elongated groove and the lower surface layer is flat and smooth.

5. The three dimensional air cushion as claimed in claim 1, wherein the lower surface layer is provided with at least one recessed elongated groove, and the upper surface layer is flat and smooth.

6. The three dimensional air cushion as claimed in claim 1, wherein the upper surface layer and the lower surface layer are provided with at least one recessed elongated groove.

7. The three dimensional air cushion as claimed in claim 6, wherein said at least one recessed elongated groove is provided in said upper surface layer and lower surface layer and are connected with each other.

8. The three dimensional air cushion as claimed in claim 1, further comprising a component in one of a shoe, a sneaker, a protective pad, and a helmet, for providing a buffer and shock-absorbing effect.

9. The three dimensional air cushion as claimed in claim 1, further including an inlet for filling fluid.

10. The three dimensional air cushion as claimed in claim 9, further including a valve device.

11. The three dimensional air cushion as claimed in claim 9, further including a pump device.

12. The three dimensional air cushion as claims 9, wherein said plurality of interconnected air chambers are filled with a liquid fluid.

13. The three dimensional air cushion as claimed in claim 9, wherein said plurality of interconnected air chambers are filled with a semi-liquid fluid.

14. The three dimensional air cushion as claimed in claim 9, wherein said plurality of interconnected air chambers are filled with a foam material.

15. The three dimensional air cushion as claimed in claim 9, wherein said plurality of interconnected air chambers are filled with a gas other than air.

16. A three dimensional air cushion comprising:

a plurality of interconnected air chambers, said plurality of interconnected air chambers defining a base portion and two opposed substantially vertical lateral sides located on opposite sides of the base portion to form a concave structure, the base portion and the two lateral sides being formed between an upper surface layer and a lower surface layer bounding an interior space, said two opposed lateral sides projecting above a plane containing said base portion to form elevated sidewalls of air cushioning capability with the base portion for distributing shock forces delivered to at least one of the plurality of interconnected air chambers at one of the two sidewalls and distributing the shock forces throughout a remainder of the plurality of interconnected air chambers including the base portion, and an inner surface area defined by said upper surface layer being smaller than an outer surface area defined by said lower surface layer.

17. The three dimensional air cushion as claimed in claim 16, wherein said plurality of interconnected air chambers are sealed.

18. The three dimensional air cushion as claimed in claim 16, wherein said plurality of interconnected air chambers have a one-way valve to communicate with open air.

19. The three dimensional air cushion as claimed in claim 16, where the upper surface layer is provided with at least one recessed elongated groove and the lower surface layer is flat and smooth.

20. The three dimensional air cushion as claimed in claim 16, wherein the lower surface layer is provided with at least one recessed elongated groove, and the upper surface layer is flat and smooth.

21. The three dimensional air cushion as claimed in claim 16, wherein the upper surface layer and the lower surface layer are provided with at least one recessed elongated groove.

22. The three dimensional air cushion as claimed in claim 21, where said at least one recessed elongated groove is provided in said upper surface layer and said lower surface layer and are connected with each other.

23. The three dimensional air cushion as claimed in claim 16, further comprising a component in one of a shoe, a sneaker, a protective pad, and a helmet, for providing a buffer and shock-absorbing effect.

24. The three dimensional air cushion as claimed in claim 16, further including an inlet for filling fluid.

25. The three dimensional air cushion as claimed in claim 24, further including a valve device.

26. The three dimensional air cushion as claimed in claim 24, further including a pump device.

27. The three dimensional air cushion as claims 24, wherein said plurality of interconnected air chambers are filled with a liquid fluid.

28. The three dimensional air cushion as claimed in claim 24, wherein said plurality of interconnected air chambers are filled with a semi-liquid fluid.

29. The three dimensional air cushion as claimed in claim 24, wherein said plurality of interconnected air chambers are filled with a foam material.

30. The three dimensional air cushion as claimed in claim 24, wherein said plurality of interconnected air chambers are filled with a gas other than air.

31. A three dimensional air cushion comprising;

a plurality of interconnected air chambers, said plurality of interconnected air chambers defining a base portion and two opposed lateral sides located on opposite sides of and extending from the base portion to form a substantially concave structure, the base portion and the two lateral sides being formed between an upper surface layer and a lower surface layer bounding an interior space, said two opposed lateral sides projecting above a plane containing said base portion to form elevated sidewalls of air cushioning capability with the base portion for distributing shock forces delivered to at least one of the plurality of interconnected air chambers at one of the two sidewalls and distributing the shock forces throughout a remainder of the plurality of interconnected air chambers including the base portion; and at least one recess extending from at least one of said upper surface layer and said lower surface layer and separating portions of said plurality of interconnected air chambers.

32. The three dimensional air cushion as claimed in claim 31, wherein said plurality of interconnected air chambers are sealed.

33. The three dimensional air cushion as claimed in claim 31, wherein said plurality of interconnected air chambers have a one-way valve to communicate with open air.

34. The three dimensional air cushion as claimed in claim 31, wherein the at least one recess is at least one recessed elongated groove in the upper surface layer and the lower surface layer is flat and smooth.

35. The three dimensional air cushion as claimed in claim 31, wherein the at least one recess is at least one recessed elongated groove in the lower surface layer and the upper surface is flat and smooth.

36. The three dimensional air cushion as claimed in claim 31, wherein the upper surface layer and the lower surface layer are provided with at least one recessed elongated groove.

37. The three dimensional air cushion as claimed in claim 36, wherein said at least one recessed elongated groove is provided in said upper surface layer and said lower surface layer and are connected with each other.

38. The three dimensional air cushion as claimed in claimed 31, further comprising a component in one of a shoe, a sneaker, a protective pad, and a helmet, for providing a buffer and shock-absorbing effect.

39. The three dimensional air cushion as claimed in claim 31, further including an inlet for filling fluid.

40. The three dimensional air cushion as claimed in claim 39, further including a valve device.

41. The three dimensional air cushion as claimed in claim 39, further including a pump device.

42. The three dimensional air cushion as claims 39, wherein said plurality of interconnected air chambers are filled with a liquid fluid.

43. The three dimensional air cushion as claimed in claim 39, wherein said plurality of interconnected air chambers are filled with a semi-liquid fluid.

44. The three dimensional air cushion as claimed in claim 39, wherein said plurality of interconnected air chambers are filled with a foam material.

45. The three dimensional air cushion as claimed in claim 39, wherein said plurality of interconnected air chambers are filled with a gas other than air.

* * * * *